US006712205B2

(12) United States Patent
Lee

(10) Patent No.: US 6,712,205 B2
(45) Date of Patent: Mar. 30, 2004

(54) GOLF CLUB BAG

(75) Inventor: Michael Lee, Chino Hills, CA (US)

(73) Assignee: Nickent Golf Equipment Company, City of Industry, CA (US)

( * ) Notice: Subject to any disclaimer, the term of this patent is extended or adjusted under 35 U.S.C. 154(b) by 0 days.

(21) Appl. No.: 10/132,633

(22) Filed: Apr. 24, 2002

(65) Prior Publication Data

US 2003/0201197 A1 Oct. 30, 2003

(51) Int. Cl.[7] ..... A63B 55/00
(52) U.S. Cl. ..... 206/315.5; 211/70.2; 280/DIG. 5
(58) Field of Search ..... 206/315.2–315.6, 206/315.8; 224/918, 919; 280/DIG. 5, DIG. 6; 211/70.2, 70.5, 60.1, 69.5

(56) References Cited

U.S. PATENT DOCUMENTS

| | | | | | |
|---|---|---|---|---|---|
| 1,434,621 | A | * | 11/1922 | Marwood et al. | 206/315.6 |
| 1,939,488 | A | * | 12/1933 | Dent et al. | 206/315.8 |
| 2,879,819 | A | | 3/1959 | Turnbull | |
| 3,053,298 | A | * | 9/1962 | Stamp | 206/315.2 |
| 4,173,241 | A | * | 11/1979 | Stock | 206/315.6 |
| 4,596,328 | A | | 6/1986 | Solheim | |
| 4,881,638 | A | | 11/1989 | Cho | |
| 4,949,844 | A | | 8/1990 | Yang | |
| 5,099,990 | A | * | 3/1992 | Antonious | 206/315.6 |
| 5,103,974 | A | | 4/1992 | Antonious | |
| 5,135,107 | A | | 8/1992 | Ingraham | |
| 5,228,566 | A | * | 7/1993 | Shenoha | 206/315.6 |
| D365,205 | S | * | 12/1995 | Holland, III | D3/255 |
| 5,860,520 | A | | 1/1999 | Tang | |
| 5,918,737 | A | * | 7/1999 | Kwon | 206/315.3 |
| 5,988,379 | A | * | 11/1999 | Yearous | 206/315.3 |

* cited by examiner

*Primary Examiner*—Lee Young
*Assistant Examiner*—Lien Ngo
(74) *Attorney, Agent, or Firm*—Fay, Sharpe, Fagan, Minnich & McKee, LLP

(57) ABSTRACT

A golf bag having a tubular body having a first open end and a second closed end, a pocket attached to the tubular body adapted to place a separate club in it, and a projection extending from an edge of the open end of the body to preclude the separated club from hitting the rest of the clubs in a set of golf clubs placed into the bag.

4 Claims, 4 Drawing Sheets

GOLF CLUB BAG

BACKGROUND OF THE INVENTION

The present invention relates to the field of golf club bags. Particularly, the invention relates to a bag suitable for placement on the rear of a golf cart. More particularly, this invention relates to a golf club bag having a separate pocket for a putter. The pocket allows the golfer to easily locate the putter in the bag during the round.

During a round of golf, a golfer carries a series or set of golf clubs in a golf bag. The golf bag is often arranged in a vertical position on a golf cart. Before a golfer takes a shot he must select a club from his bag and after shooting he will place the club back into the bag. Because of the similarity in appearance of many of the clubs in a set and the typical crowding of the clubs in the bag, a golfer can become easily frustrated trying to locate a particular club for his next shot.

A golfer generally uses a putter more times in an ordinary round of golf than any other club in the bag. Since the putter is usually the shortest club among the set, it can easily be the most difficult club to locate in the golf bag. Accordingly, a golf club bag having a separate compartment for storing a putter during the golf round is desirable.

SUMMARY OF THE INVENTION

According to one embodiment, the golf club bag of this invention comprises a substantially tubular body having a first open end and a second at least substantially closed end. The bag further includes a rigid member attached to an outer surface of the body. The member and the outer surface of the body define a pocket where the golfer can place a putter. The bag also includes a projection extending from an edge of the open body substantially in the same plane as the member mounted on the body. The projection provides a barrier between the putter and the rest of the set of clubs so that the putter does not contact the other clubs in the set that are placed in the body as the clubs move throughout the golfer's round. The height of the projection in the preferred embodiment should be about equal to the height of the putter head when the putter is placed into the pocket.

Preferably, the member attached to the outer surface of the bag defines a pocket that decreases in diameter in the direction towards the closed end of the bag. This allows for a wide opening at the top making it easy for a golfer to place a putter in the bag. The pocket being on the outside of the tubular body makes placement of the putter into the pocket and retrieval from the pocket very easy because the putter shaft does not intermingle with other golf club shafts during placement or retrieval.

BRIEF DESCRIPTION OF THE DRAWINGS

Other characteristics and advantages of the invention will become apparent from the following description, with reference to the drawings of a preferred embodiment of the invention, in which.

DETAILED DESCRIPTION OF THE INVENTION

Reference will now be made in detail to an exemplary embodiment of the invention, an example of which is illustrated in the accompanying drawings. While this invention will be described in connection with an exemplary embodiment, it will be understood that it is not intended to limit the invention to that embodiment. On the contrary, it is intended to cover all alternatives, modifications and equivalents that may be included within the spirit and scope of the invention defined by the appended claims.

The patent disclosure frequently refers to a "putter" pocket, however this disclosure and the appended claims are not limited to bags having putter compartments and may fairly cover golf bags having a compartment carrying any type of club. The references "front," "rear," "lateral," "top," and "bottom" are used for better understanding of the invention and with respect to orientation to the golf bag as the bag is placed on a pull cart or golf cart. These terms cannot limit the scope of the invention as a function of the presentation thereof. Simply for the case of description, the golf bag described in the disclosure is symmetrical, it is understood that an asymmetrical bag falling within the scope of the claims is inside the scope of the invention.

Figure 1:
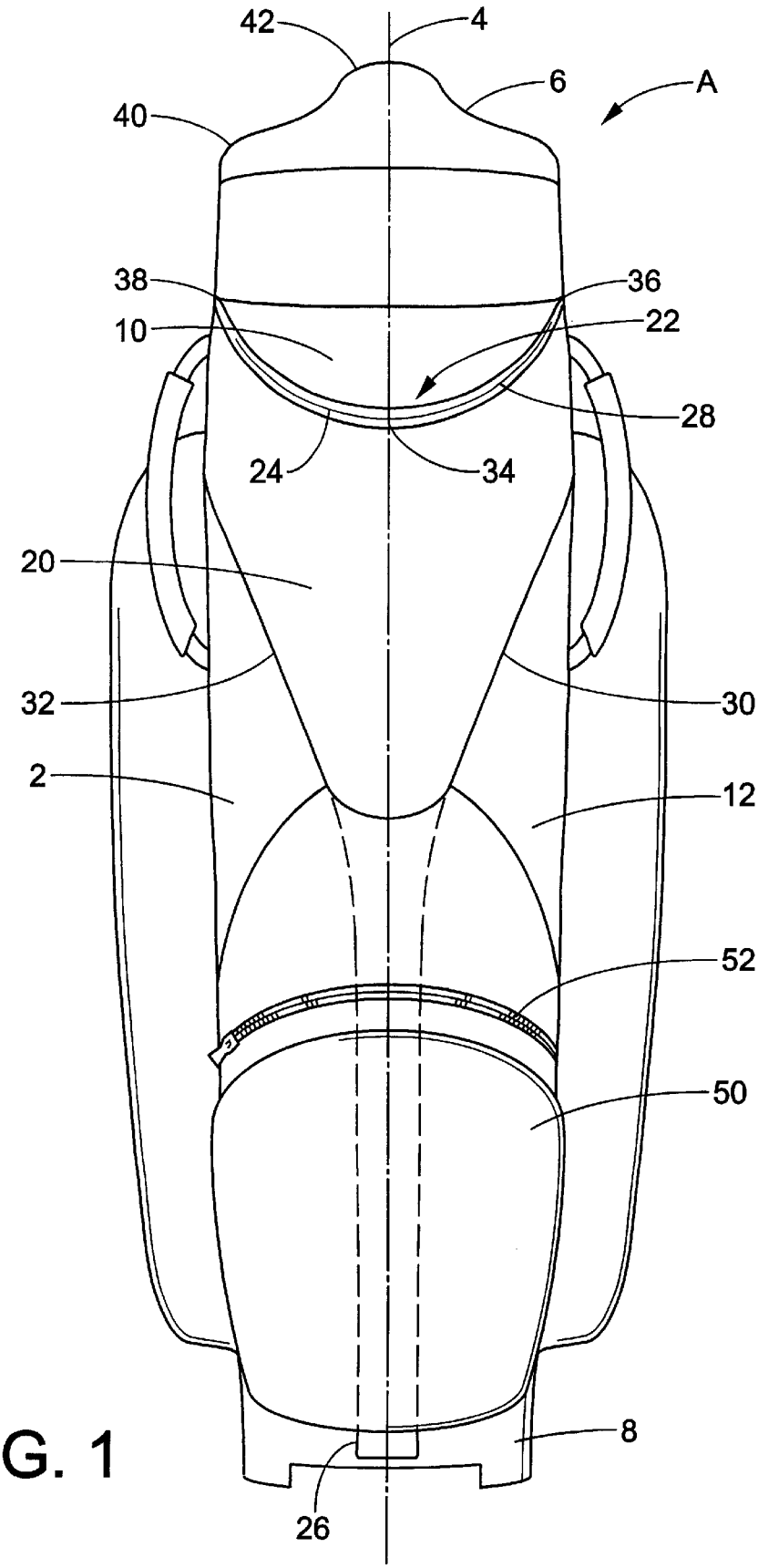
FIG. 1 is a front elevational view of the golf bag.

Referring now to FIG. 1, the inventive golf bag A comprises a substantially tubular body 2 having a longitudinal axis 4 with a first open end 6 and a second opposed at least substantially closed end 8. The body can be made from a rigid and durable material which in the preferred embodiment is a plastic such as ethylene-vinyl acetate, high impact polystyrene or acrylonitrile-butadiene-styrene. Other materials with similar characteristics also may be used. The body carries the set of clubs including a putter. The height of the body is determined by the length of the golf clubs that the bag carries. The bag usually has a height sufficient to protect substantially most of the golf club shafts, while allowing the golfer to easily grip and retrieve a golf club from the bag. The body has a diameter large enough to allow the bag to hold a set of clubs, usually fourteen (14). The clubs are placed into the bag through the first open end 6. A longitudinal axis 4 generally bisects the bag vertically.

A member 20 attaches at its terminal edges 30, 32 to an outer surface 10 of the body 2. In the preferred embodiment, the member is attached at the front side 12 of the bag. The member in combination with the outer surface of the body defines a pocket 22 where a putter can be placed. The member has a first end 24 that defines an opening between the member and the outer surface. The member also has a second end 26 that is at least substantially closed. The member has a generally parabolic-shaped edge 28 located at the first end 24 of the member.

The member 20 can be made of a similar rigid material as body 2. The distance between the member 20 and the outer surface 10 of the body 2 defines a pocket 22. The width of the pocket, defined by the distance between the member 20 and the outer surface 10, is wide enough to allow a putter to easily be placed in and removed from the pocket. The first end 24 of the member has a parabolic edge 28 with the vertex 34 of the parabola being substantially centered on the longitudinal axis 4 and terminal ends 36, 38. The generally parabolic shape of the top edge 28 allows the putter to be easily placed into and removed from the pocket 22 because more surface area at the first end 24 of the pocket 22 is exposed. With the vertex 34 of the parabolic shaped edge being located substantially on the longitudinal axis 4, the edge 28 terminal ends 36, 38 are near the member 20 terminal edges 30, 32 at the member first end 24. The distance between the first terminal end 36 and the second terminal end 38 of the parabolic edge 28 is wider than the distance between the first terminal edge 30 and the second terminal edge 32 (shown in phantom) of the member at the second end 8 of the bag. The terminal edges 30, 32 are tapered from a wider position near the first end 6 of the bag to a narrower position near the second end 8. This allows the pocket to gradually approximate a diameter slightly larger than the diameter of the putter handle. When the golfer places the putter back into the bag, he can place the putter just about anywhere in the large surface area provided at the top of the pocket. As the handle of the putter fall towards the bottom of the pocket, the putter returns substantially to a vertical upright position because the pocket confines the handle in a small diameter (near the bag second end 8) vertically oriented pocket.

An edge 40 surrounds the open end 6 of the golf bag. The edge can be a separate rigid element attached to the tubular body 2 or the edge could also be made as part of the body. The edge 40 has a projection 42 extending from its top edge. In the preferred embodiment, the projection is substantially in line with the longitudinal axis 4 and located substantially on the same side of the body 2 as the member 20, usually the front. The projection 42 is adapted to preclude the putter from contacting the rest of the set of clubs while the putter is placed in pocket 22. For example, when the bag is placed on the back of a golf cart and the golfer is driving the cart to his next shot the bag and its contents are jostled throughout the journey. The projection will act as a barrier between the putter head and the rest of the clubs so that the putter head will not hit the other clubs during the journey. In this way the head of the putter is protected without having to use a separate head cover.

Figure 3:
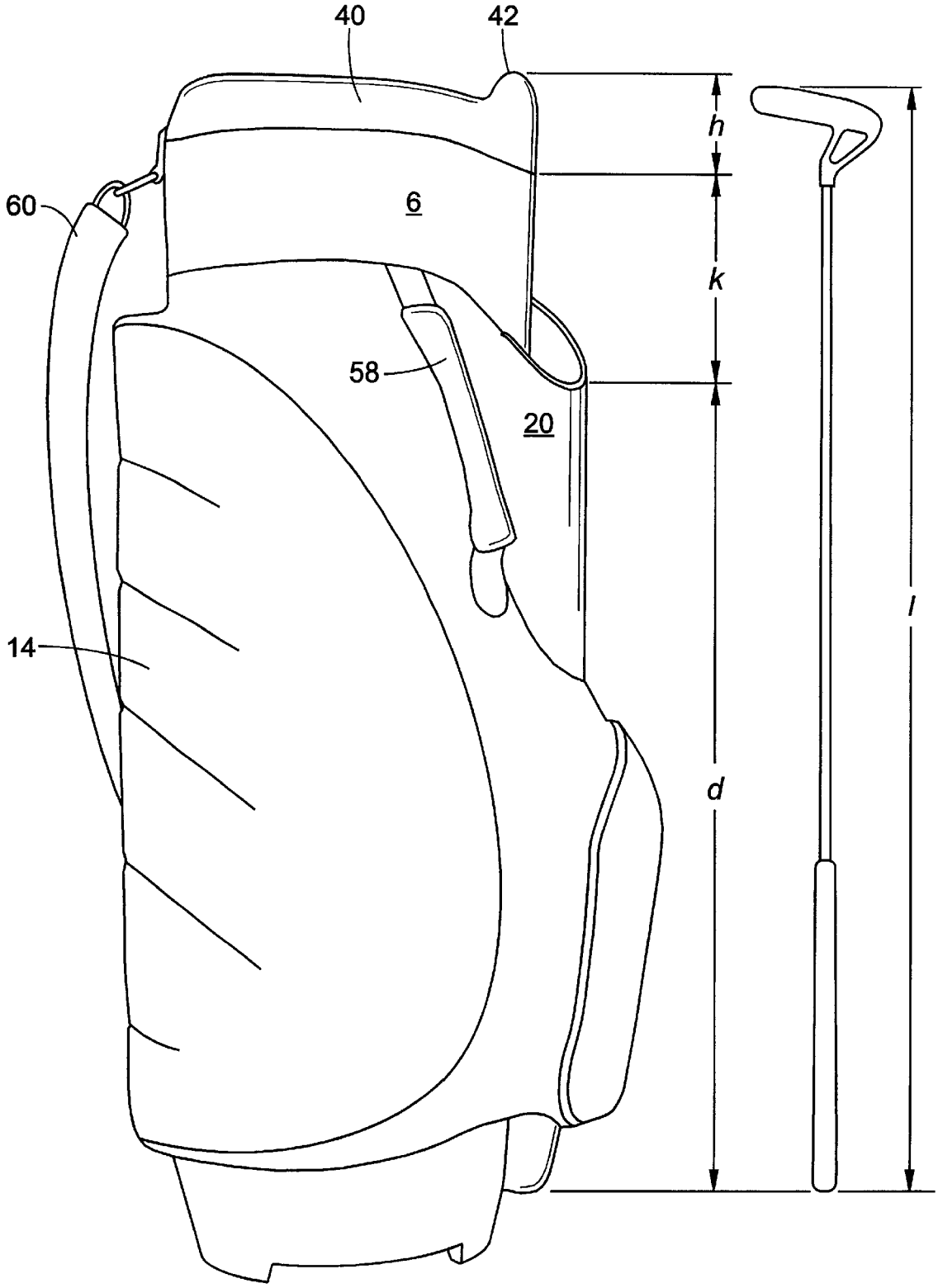
FIG. 3 is a side elevational view of the upper portion of the golf bag.

As best seen in FIG. 3, the proper height of the projection can be determined by roughly following the formula l is approximately equal to d+h+k where l is the length of the putter, d is the depth of the pocket 22 as measured from the vertex 34 of the parabolic edge 28, h is the height of the projection above a top end of edge 40, and k is the distance between the top end of edge 40 and vertex 34. The width of the projection is sufficiently wide enough to preclude contact and also to provide sufficient rigidity to the projection.

Figure 2:
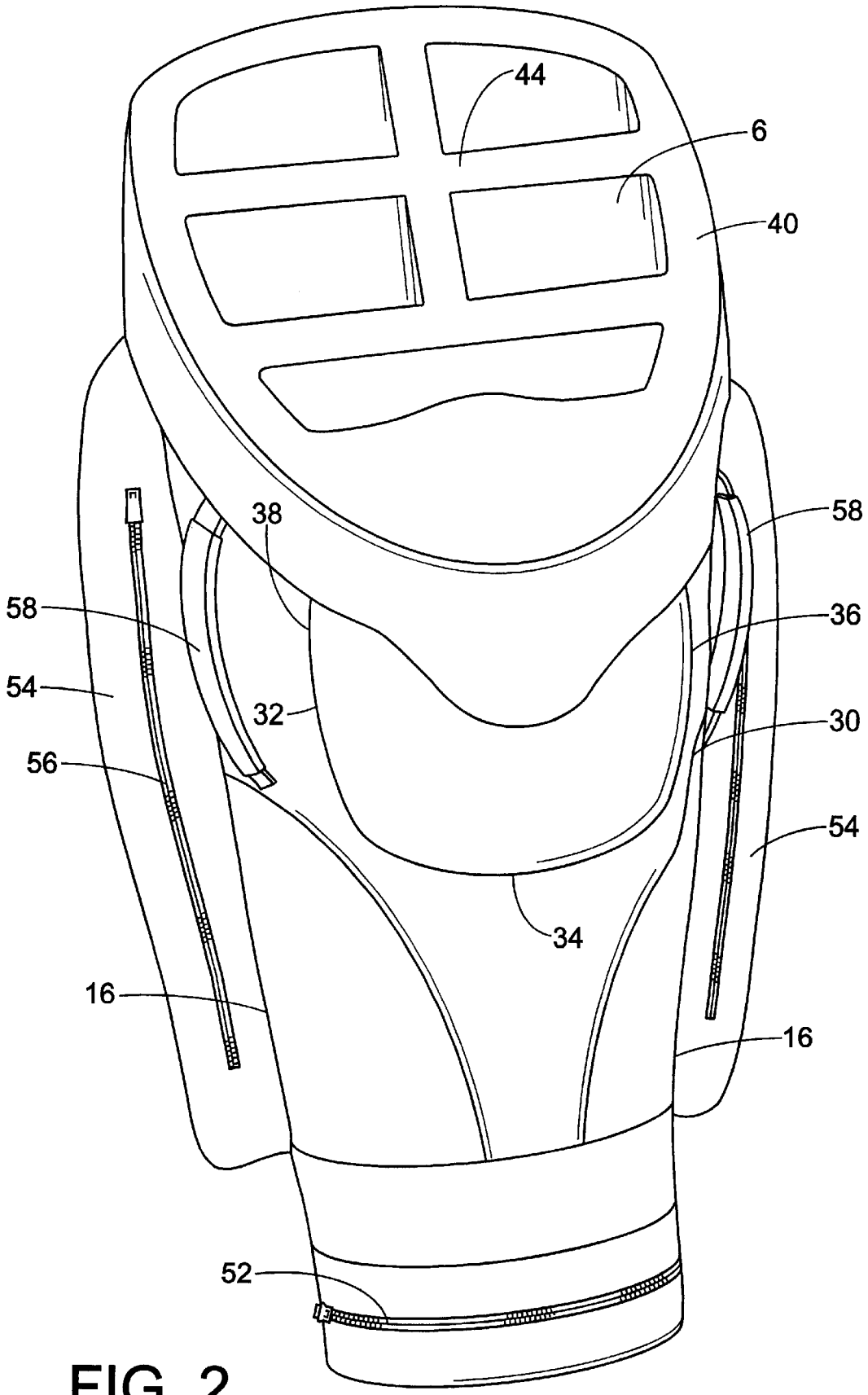
FIG. 2 is a front perspective view of the upper portion of the golf bag.

Referring to FIG. 2, club dividers 44 may be connected to the edge 40. The club dividers separate the clubs in the set while they are placed in the body 2 through open end 6 as best seen in FIG. 2. The club dividers allow the golfer to organize the clubs to his liking in the bag and also prevent the shafts of the clubs from getting intertwined.

Figure 4:
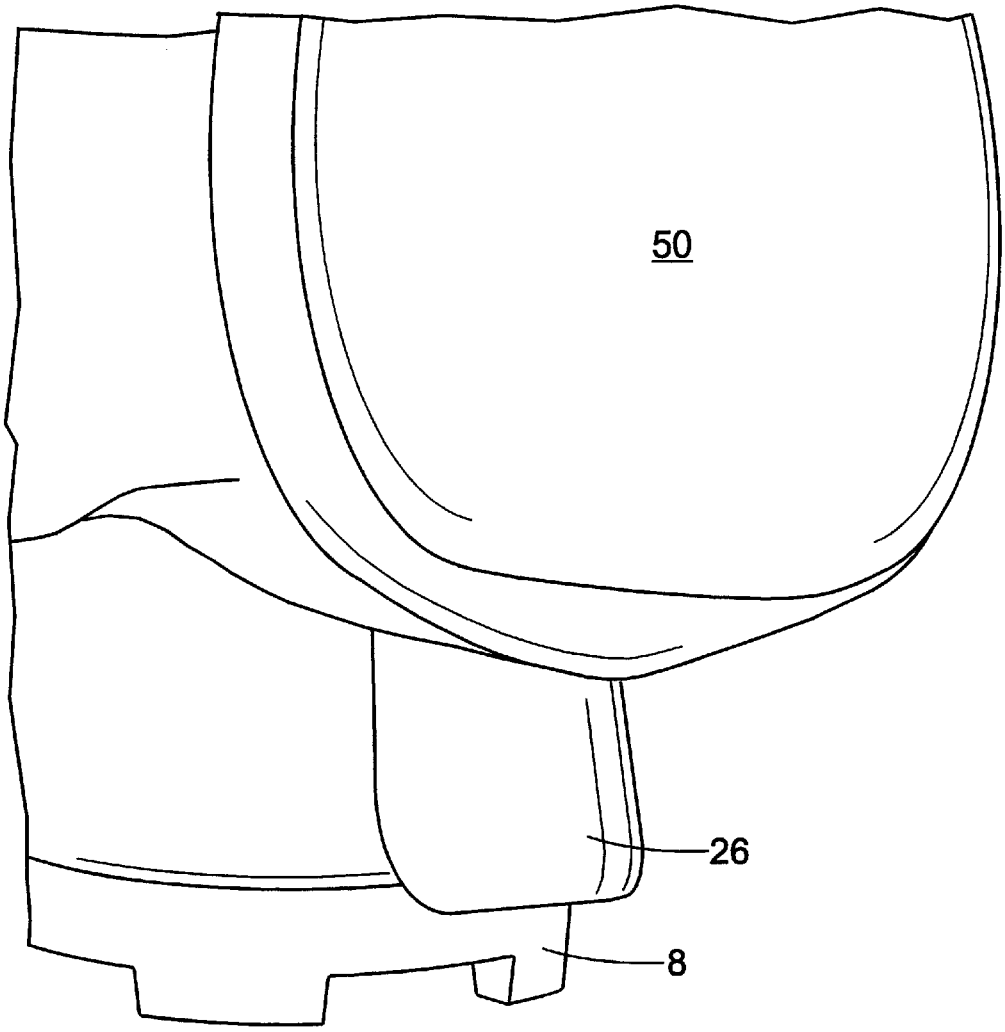
FIG. 4 is a perspective view of the lower portion of the golf bag.

Referring back to FIG. 1, in the preferred embodiment, the golf bag may also include a bottom pouch 50 most likely used to carry golf balls. The bottom pouch 50 is connected to the same side of the bag as the member 20, preferably the front side 12. The bottom pouch surrounds member 20, with member 20 extending through the bottom pouch at its second end 26 best seen in FIG. 4. The bottom pouch is accessible by way of a zipper 52, however other means such as velcro or other fasteners may also be used to selectively open and close the bottom pouch.

Referring to both FIGS. 1 and 2, the golf bag may also have lateral compartments 54 attached to lateral sides 16 of the golf bag. The lateral compartments may cover substantially the entire lateral sides of the golf bag. The lateral compartments may also have zippers 56 to allow for selective opening and closing of the compartment, however other fasteners such as velcro, buttons or the like may also be used to open and close the lateral compartments. The bag may also have handles 58 mounted on it. In the preferred embodiment the handles are mounted on the lateral sides of the golf bag. The handles may be adapted to allow a strap from the rear of a golf cart to slide through the handles to more securely fasten the golf bag to the back of a golf cart. As seen in FIG. 3, the golf bag may also include a strap 60 that facilitates the carrying of a bag by a golfer allowing the golfer to carry the bag using the strap placed over his shoulder. The strap is usually mounted on the rear side 14 of the bag. The rear side of the bag is substantially planar to facilitate placement of the bag onto a pull cart or golf cart.

When the bag is placed onto a golf cart the rear side 14 is placed on facing the front of the cart so that the front side of the bag is accessible to the golfer from the rear of the cart. With this orientation, the golfer has easy access to his clubs through open end 6, his putter placed in the pocket 22, the bottom pouch 50 and the lateral compartments 54. The means for selectively opening the pouch 50 and compartments 54 can be located on the front side of the bag so that the golfer has easy access to the contents of the pouch and compartments when the bag is placed on the cart.

Although the present invention has been described in detail with reference to a certain preferred embodiment, other versions are possible. As just one example, the placement of the member, pouch or compartments could be rearranged to make a bag more suitable for a golfer who wishes to carry his bag throughout the round. Therefore, the scope of the invention is not limited to the embodiment that has been just described as a preferred embodiment. The invention extends to any device that falls within the scope of the appended claims.

Having thus described the invention, it is claimed:

1. A golf club bag comprising:

a substantially tubular body having a longitudinal axis with a first open end and a second opposed at least substantially closed end;

a rigid member attached to an outer surface of a first side of the body, wherein the member in combination with the outer surface of the body define a pocket having an open portion towards and below the first open end of the body and an at least substantially closed portion towards the at least substantially closed end of the body, wherein the pocket progressively narrows in diameter in the direction away from the open portion; and a projection extending from an edge of the open end of the body substantially parallel to the longitudinal axis and substantially on the first side of the body.

2. The golf club bag according to claim 1, further comprising a pouch That at least partially surrounds the rigid member.

3. The golf club bag according to claim 1, wherein the rigid member further comprises a generally parabolic-shaped edge forming the open portion.

4. The golf club bag according to claim 2, wherein the rigid member extends through the pouch.

* * * * *